US005427188A

United States Patent [19]

Fisher

[11] Patent Number: 5,427,188

[45] Date of Patent: Jun. 27, 1995

[54] POWER TOOL

[76] Inventor: Hugh E. Fisher, Dunree Farm Cottage, Dalrymple, Ayrshire, KA6 6BA, Scotland, United Kingdom

[21] Appl. No.: 244,876

[22] PCT Filed: Dec. 18, 1992

[86] PCT No.: PCT/GB92/02352

§ 371 Date: Jun. 16, 1994

§ 102(e) Date: Jun. 16, 1994

[87] PCT Pub. No.: WO93/11910

PCT Pub. Date: Jun. 24, 1993

[30] Foreign Application Priority Data

Dec. 19, 1991 [GB] United Kingdom ..... 9126970

[51] Int. Cl.[6] ..... B25D 11/10

[52] U.S. Cl. ..... 173/205; 74/55

[58] Field of Search ..... 173/114, 117, 205, 122, 173/124; 74/55, 56, 60

[56] References Cited

U.S. PATENT DOCUMENTS

| | | | |
|---|---|---|---|
| 1,777,875 | 10/1930 | Champayne | 173/205 |
| 2,051,053 | 8/1936 | Morris | 173/205 |
| 2,970,483 | 2/1961 | Schrum, Sr. | 173/205 |
| 3,322,208 | 5/1967 | Skoog | 173/205 |
| 3,430,709 | 3/1969 | Miller | 173/205 |

FOREIGN PATENT DOCUMENTS

| | | |
|---|---|---|
| 775120 | 12/1934 | France . |
| 186142 | 9/1922 | United Kingdom . |
| 612866 | 11/1948 | United Kingdom . |
| 2219958 | 12/1989 | United Kingdom . |

*Primary Examiner*—Scott A. Smith
*Attorney, Agent, or Firm*—Gifford, Krass, Groh, Sprinkle, Patmore, Anderson & Citkowski

[57] ABSTRACT

The invention relates to portable power tool intended to form part of a power tool or a conversion unit adapted to be fitted to the shaft of a power tool. The tool includes a rotary cam member (6, 8) having an internal sinusoidal cam track (12) in which cam followers (26) of an output shaft (2) are received. When the cam member (6, 8) rotates, the shaft (2) is caused to partake of a lengthwise reciprocating movement suitable for application to a scraper bit or other tool kit such as a chisel. In an example of the invention, the shaft (86) passes through a fixed bearing ring (88), a slidable sleeve (96) being provided to control engagement of the shaft (86) via a key member (104) with portions of the ring (88) or the cam member (76), so as to enable the shaft (86) to partake of lengthwise movement or to be convertible to rotational movement, as selected by the operator.

10 Claims, 7 Drawing Sheets

POWER TOOL

BACKGROUND OF THE INVENTION

The invention is concerned with power tools, particularly but not exclusively, with power tools which are relatively lightweight and suitable for use by the general public.

In my British Patent No. 2219958 there is described a portable power tool which comprises a housing and a drive means for operating a range of interchangeable tool bits such as scrapers and chisels or even tool bits which perform the function of a small spade in breaking up soil. All these power tools provide the user with the advantages of a linear path for the powered stroke of the bit, without a component of rotary motion. This is achieved by provided a cylinder cam mounted for rotation with an output shaft and provided with a circumferential sinusoidal cam track in which run cam followers associated with the drive shaft, which is captive against rotation. Tools made in accordance with the invention described in that specification are remarkably efficient in use as small hand-held tools, but if the intended purpose of the tool requires a greater cam throw range and/or a larger cam cylinder for smoothing action, the shaft portion carrying the cam followers is also enlarged making the components too cumbersome for ease of use and incorporation into a reasonably sized housing.

SUMMARY OF THE INVENTION

The present invention seeks to provide an arrangement which will increase the versatility and capability of a portable tool such as referred to above while tending to avoid the penalty of increased size of component parts.

The invention provides a portable power tool means comprising a housing, a drive means and a mounting arrangement for a selected tool bit, said drive means being adapted to drive an output shaft means in a reciprocatory axial motion with respect to a longitudinal axis thereof to drive said tool bit, wherein there is provided a rotatable cam member to convert rotary motion from the drive means into said reciprocatory motion, said cam member being provided with an axially arranged bore into which is received a portion of the output shaft means, inner walls of said bore being formed to provide a continuous sinusoidal cam track, said output shaft means portion being provided with cam follower means projecting outwardly therefrom to engage with the cam track, and means being provided to restrain said output shaft means against rotation when said output shaft means is partaking of said reciprocatory motion.

Conveniently said output shaft means may pass through the bore of the cam member and be received in bearing devices adapted to permit longitudinal motion. Alternatively, the bore may be provided with an end wall so as to form a blind bore, an end portion only of the shaft means being received therein.

It will be understood that the power tool means of the present invention may be used as a conversion unit for a conventional power tool or may form part of a combination power tool assembly.

In one example of a device according to the invention, the means to restrain the output shaft means against rotation during the reciprocal motion thereof may comprise a bearing arrangement in which a non-circular or splined portion of the shaft means is slidingly received in a corresponding-shaped passage.

In a further example of another device according to the invention, said means to restrain the output shaft means against rotation may be adapted to be releasable at the operator's option. Selection means may therefore be provided which are capable of controlling the adoption of a first mode in which said output shaft means is in a drive sequence for reciprocal motion and a second mode in which said output shaft means is in a drive sequence for rotary motion. Conveniently said selection means may comprise a slidable key arrangement.

There will now be described three examples of tools according to the invention. It will be understood that the description which is intended to be read with reference to the drawings is given by way of example only and not by way of limitation.

DETAILED DESCRIPTION OF THE PREFERRED EMBODIMENT

Figures 1, 2:
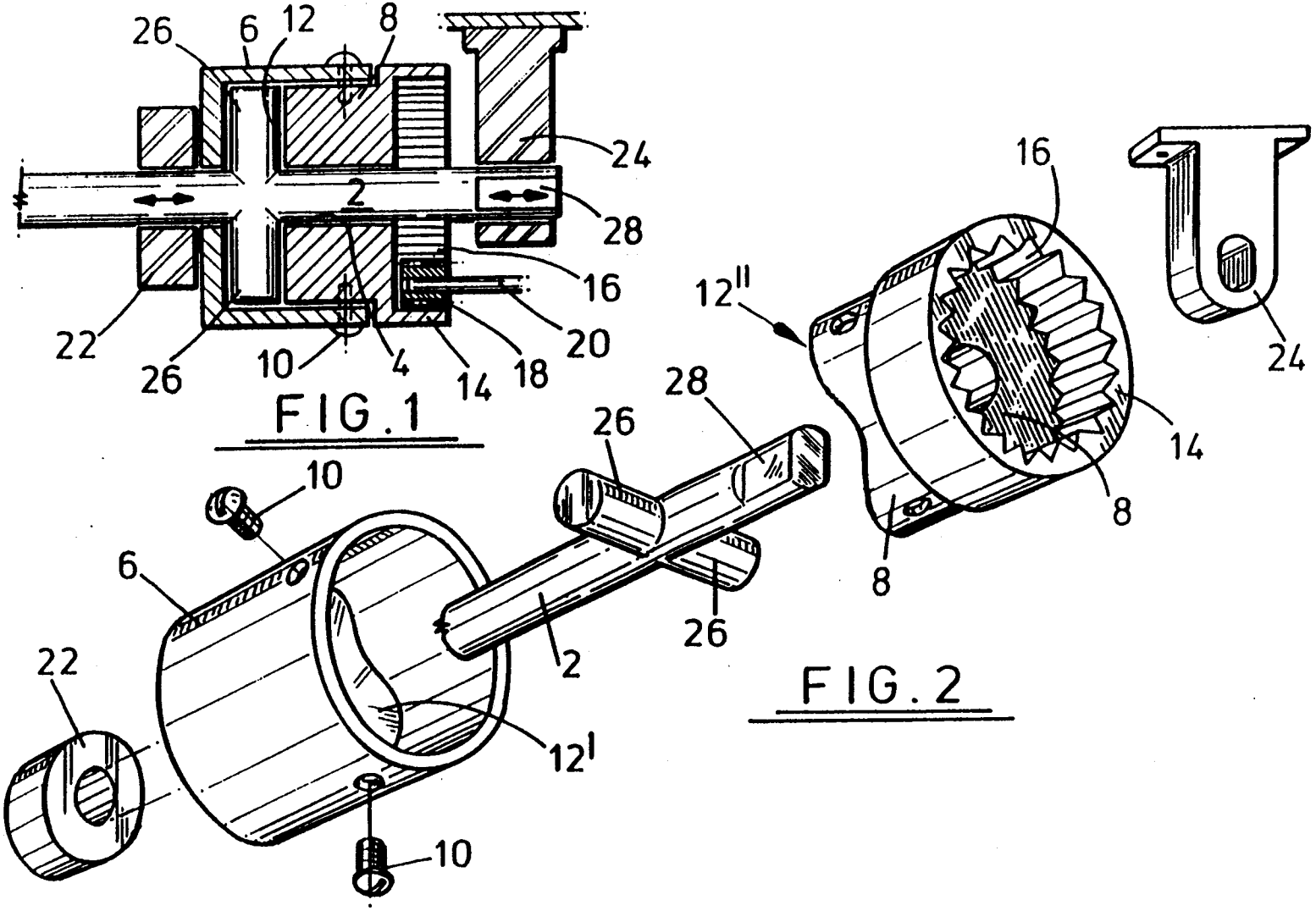
FIG. 1 is a fragmentary view in longitudinal section through a first example of a tool according to the invention.
FIG. 2 is an exploded view of the parts shown in FIG. 1.

FIGS. 1 and 2 illustrate the components parts of a first example of a tool, being those parts adapted to convert rotary motion from a motor or from an output shaft of a conventional power drill. In the latter case the parts shown in FIGS. 1 and 2 will be assembled, with an intermediate gear arrangement, into sub-housing for attachment to a power drill.

A shaft 2 passes through an axial bore 4 in a cam member comprises two parts 6, 8, secured together by fastening means, in the present example, bolts 10. The cam member 6, 8 is generally annular in shape, the inner wall of the bore 4 being formed with a recessed sinusoidal cam track 12.

It will be understood that the cam member is constructed from the two parts 6 and 8 in order to simplify manufacture. The part 6 is a sleeve member including an annular undulating flange on which is formed one side 12' of the recessed track 12. The part 8 is an annular block which has an undulating surface 12", the part 8 being received within the sleeve so that the surfaces 12' and 12" confront each other in a spaced-apart manner.

An annular flange 14 extends from the part 8 in a direction to the right of FIG. 1. The flange 14 is provided on its inner surface with splines 16 which are engaged by a pinion 18 which is connected by a shaft 20 through suitable gearing to a motor or other drive source (not shown). The parts 6 and 8 are thus rotatable by the driving pinion 18.

The shaft 2 however is restrained from rotation by being mounted in sliding bearings 22,24 the right hand end portion of the shaft being provided with flats 28 which are received in the bearing 24. Cam follower means in the form of pins or studs 26 are formed on an intermediate region of the shaft 2 so as to be received in the cam track 12 as shown in FIG. 1. Alternatively, rolling members may be preferred to the studs 26.

Thus, when the operation of the motor causes the pinion to drive the cam member 6, 8 so that it rotates, the cam followers 26 are acted upon by the curvature of the cam track so as to cause the shaft 2 to partake of axial reciprocatory movement in the bearings 22,24. The free end portion of the shaft is adapted in any suitable way to hold and retain a tool bit such as a scraper.

A second example is illustrated in FIGS. 3 to 7, in which there is shown a housing 30 which is of a shape suitable to be held in the hand. The housing 30 has a nose portion 32 to which is releasable secured a scraper bit 34. A cable 36 is provided at the rear end of the housing which provided electrical power to a motor 38 in a conventional manner. A suitable gearing arrangement 40 links the output member of the motor to an eccentrically mounted pinion 42, which is similar to the pinion 18 described above.

In this second example there is also provided a shaft 44 passing through an axial bore 46 in a cam member comprising two parts 48 and 50. However, in contrast to the first example, the bore 46 is blind having an end wall 52 formed in the part 50. The shaft 44 itself is terminated at a region to the right of studs 48, equivalent to studs 26 of FIGS. 1 and 2.

The studs 54 are arranged to act as cam-followers in a sinusoidal cam track formed by surface 56 on component part 48 and by surface 58 on component part 50 of the cam member. This camming arrangement operates in a manner similar to that described in respect of FIGS. 1 and 2, the shaft 44 sliding in a longitudinally reciprocating movement in a bearing 60, grooves 62 of which receive splines 64 on the shaft to prevent rotation thereof as the pinion 42 drives the cam member in a rotary motion through its engagement with gear teeth on the inner surface of a flange 66, similar to the flange 14 in FIG. 1. However, in the present example, the cam member 48,50 is provided with an integrally constructed shaft 68 which turns in a bearing 70.

Figure 3:
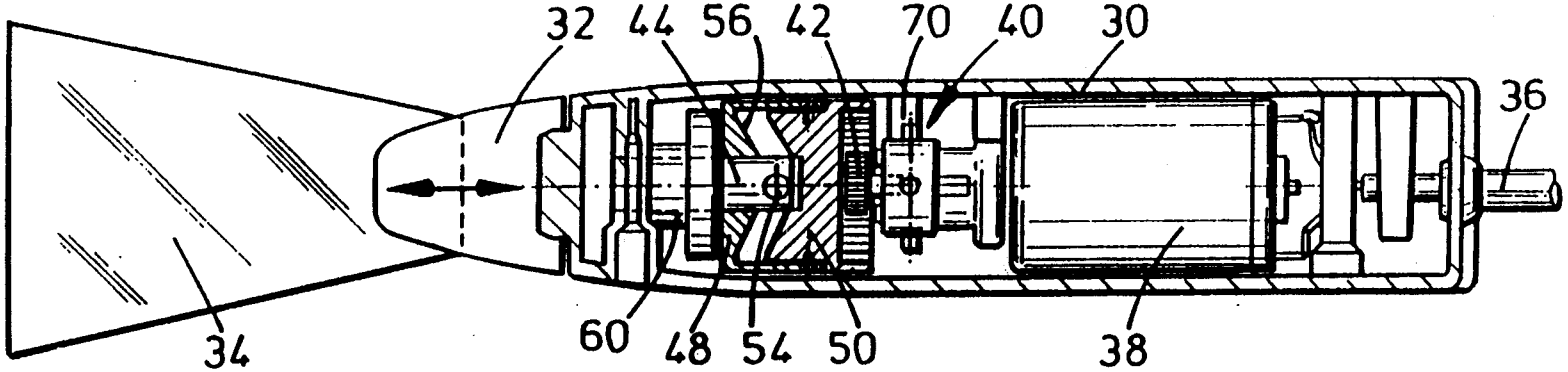
FIG. 3 is a longitudinal sectional view of the second example of a tool in an assembled condition.
Figure 4:
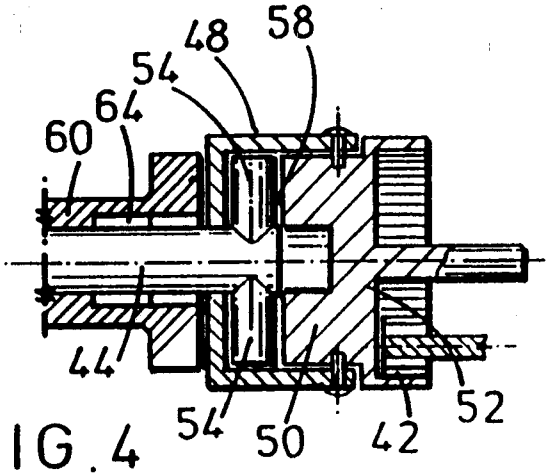
FIG. 4 is a fragmentary view of parts comprising the second example of a tool.
Figure 5:
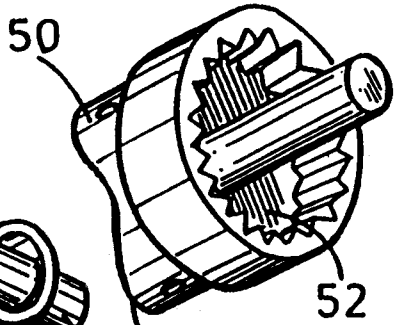
FIG. 5 is an exploded view of the parts shown in FIG. 4.
Figure 5:
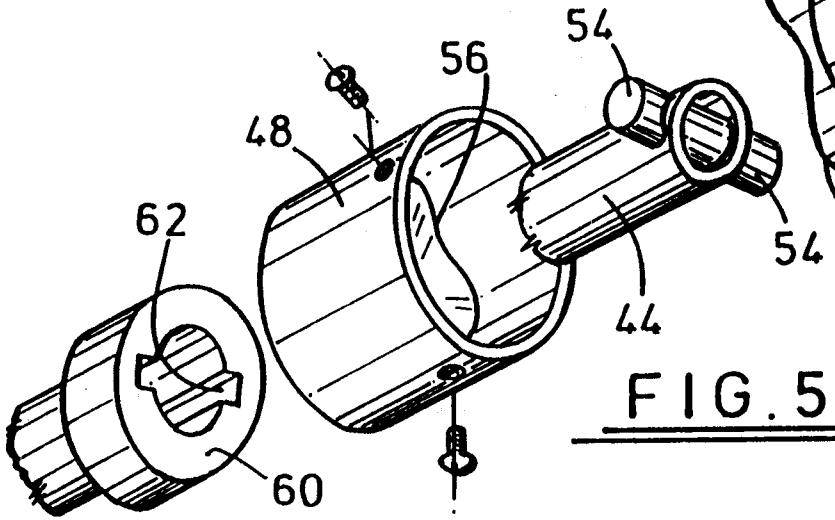
Figure 6:
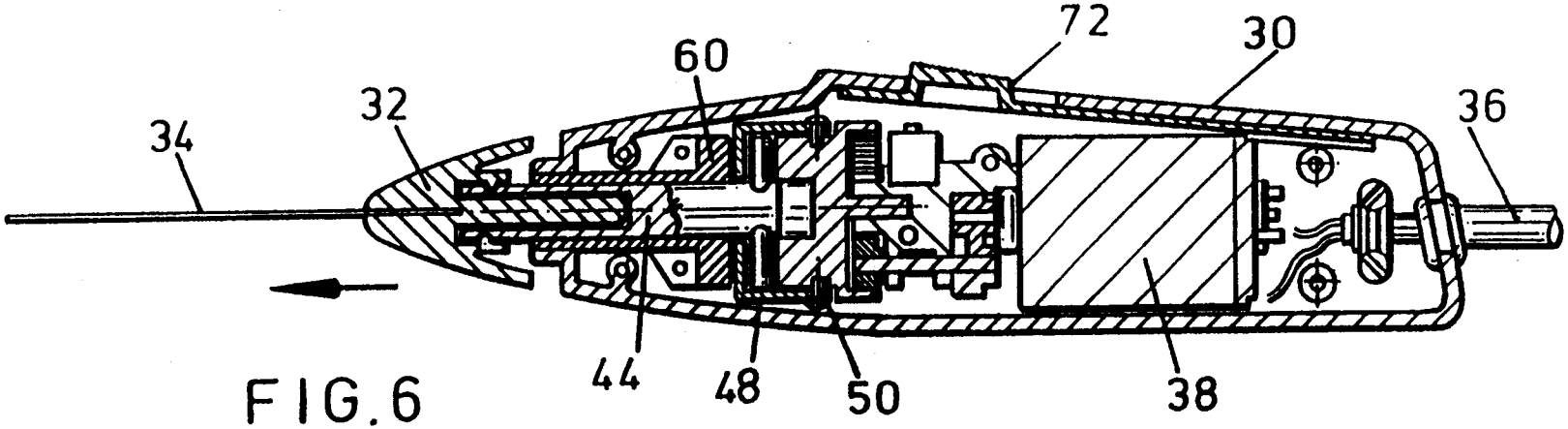
FIGS. 6 and 7 are longitudinal sectional views of the second tool with a tool bit thereof in fully forward and fully retracted positions, respectively.
Figure 7:
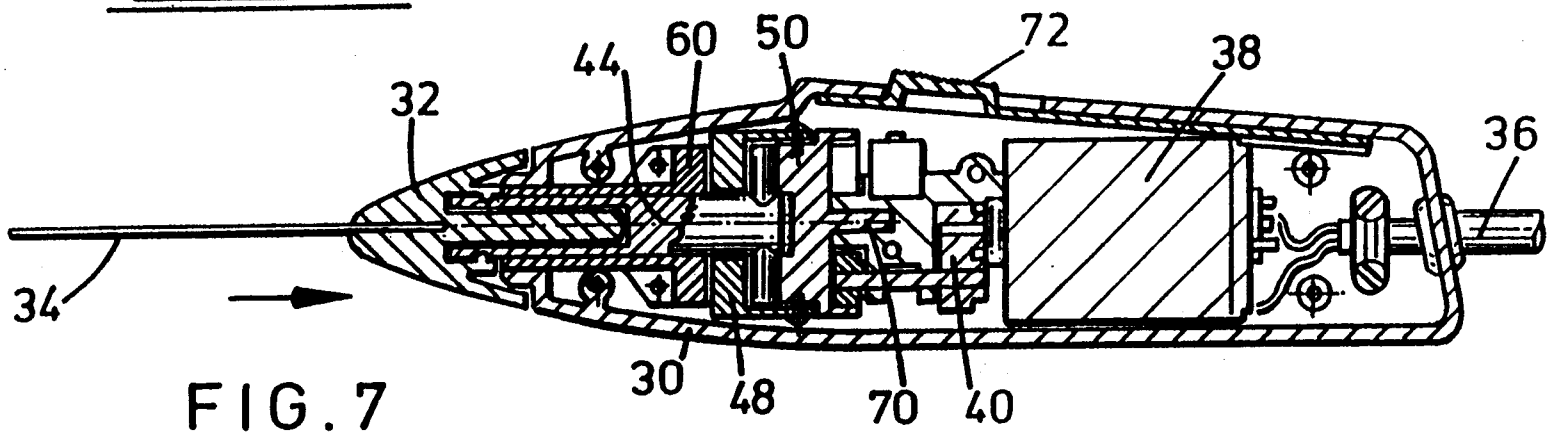

Whereas FIG. 3 is a top view of the second device, FIGS. 6 and 7 are side views thereof, illustrating the two extremes of the scraper bit travel. The lengthwise movement of the shaft 44 is apparent from a comparison of the two Figures. Operation of the motor 38 is controlled by a thumb-operated on-off switch 72.

Figure 8:
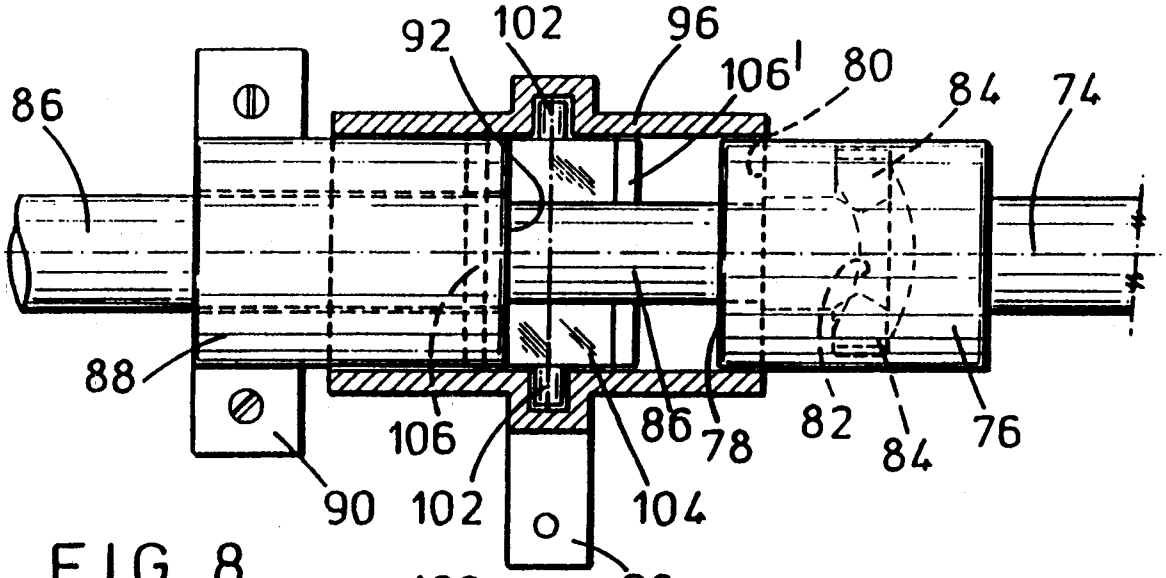
FIGS. 8 and 9 are top plan and side views respectively of operating parts in a third example of a tool.
Figure 9:
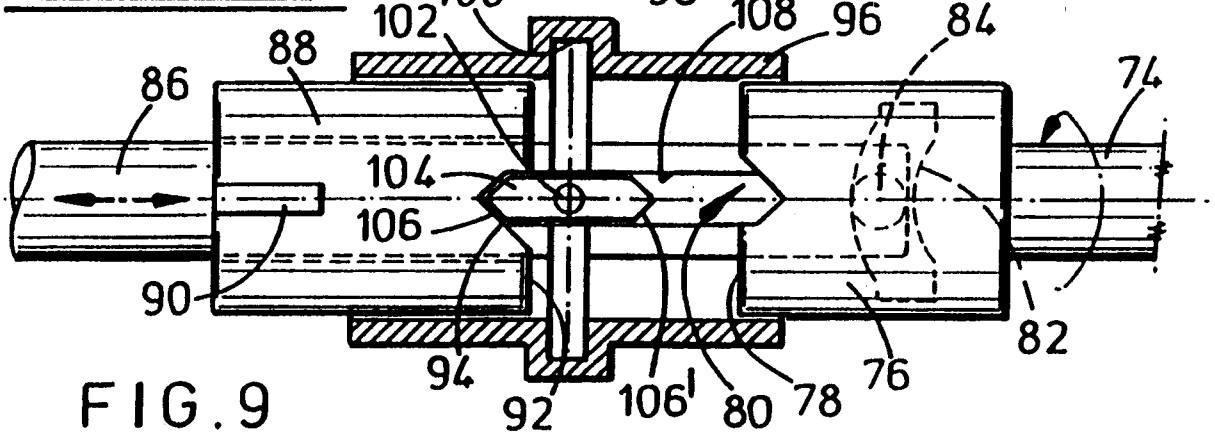

FIGS. 8 and 9 illustrate the operating component parts of a third example of a tool, comprising those parts adapted to convert rotary motion from a motor or a power-drill into reciprocal movement of an output shaft means thereof. Particularly in the case of a hand-held power drill, it is found more convenient if either reciprocating motion or rotary motion is available for selection by the operator without the need to exchange or replace the device according to the invention. This clearly increases the range and versatility of use of a drill assembly in which a single housing contains a motor having its output shaft coupled to an arrangement to be described below.

FIG. 8 shows an output shaft 74 from an electric motor similar to that shown at 38 in FIGS. 1 to 3. In the present example, the shaft 74 is connected directly to a cam member 76 for rotation thereof but it will be understood that suitable gearing may be interposed as required. The cam member 76 is of two-part construction similar to that of cam member 6, 8 or 48, 50 described above. The cam member 76 has an outer face 78 which is provided with two notched or contoured grooves indicated at 80, the purpose of which will be described below.

Received in a sinusoidal cam track 82 of the cam member 76 are two cam followers 84 arranged to project in diametrically opposed directions from an output shaft 86 of the device. The shaft 86 is further received at a position spaced bearing ring 88 fixed to a housing (not shown) by lugs 90. A surface 92 of the fixed bearing ring 88 is provided with contoured grooves 94.

External circumferential surfaces of the bearing 88 and the cam member 76 are at least partially enclosed by a sleeve member 96 which is adapted to slide between two end positions, one of which is shown in FIGS. 8 and 9. Spring means (not shown) are provided to urge the sleeve member 96 into one or other of the two positions as determined by actuation of an operating member 98.

Figures 10, 11, 12, 13:
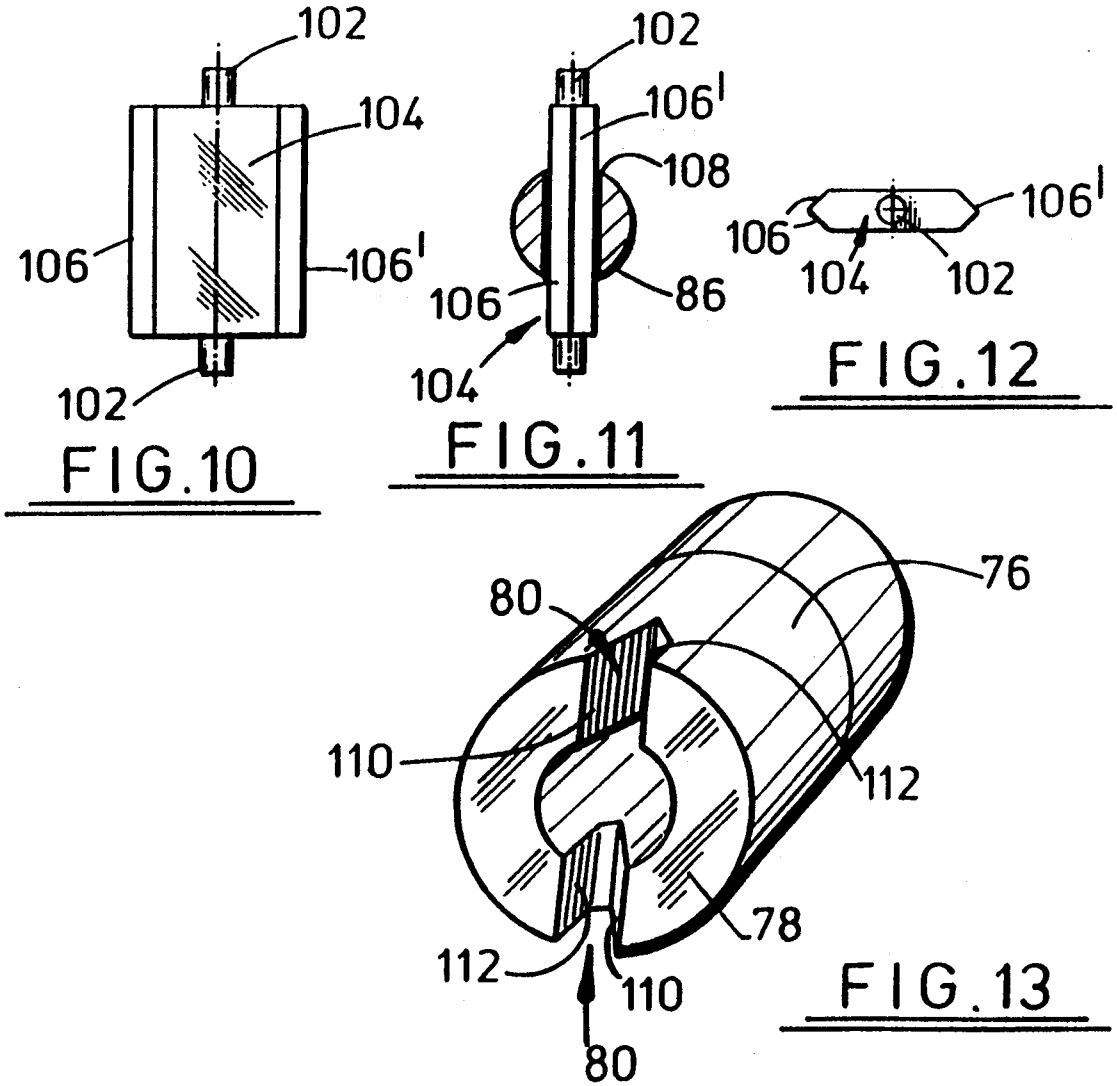
FIGS. 10, 11, and 12 are plan, side and end views of a key member of a key arrangement of the third example.
FIG. 13 is a perspective view of a cam member of the third example.
Figure 14:
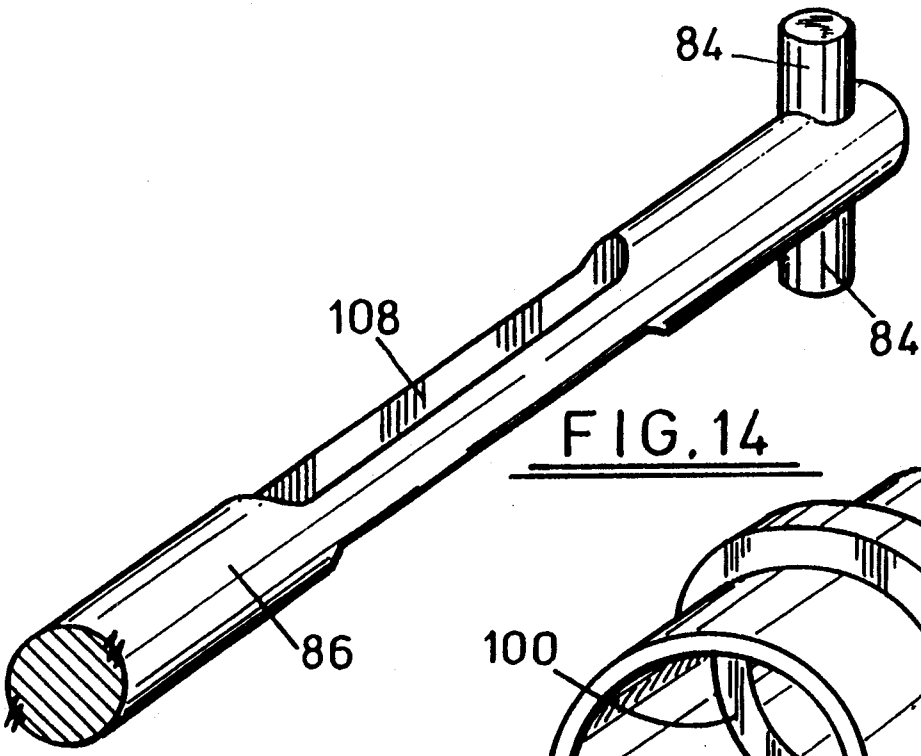
FIG. 14 is a perspective view of an output shaft means of FIGS. 8 and 9.
Figure 15:
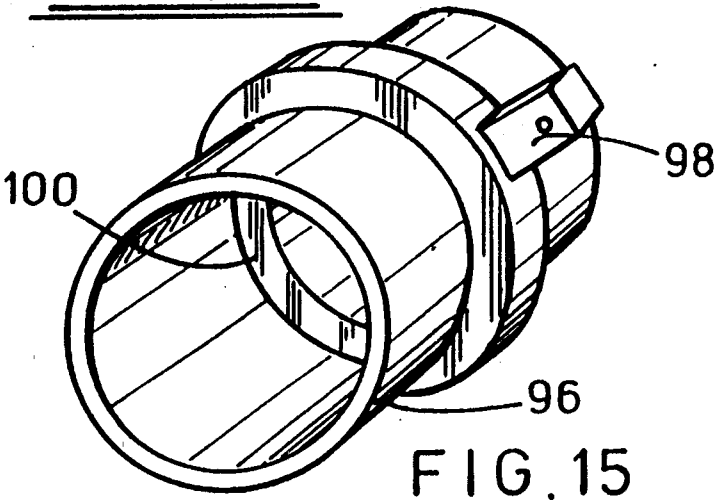
FIG. 15 is a perspective view of a slidable sleeve member of the key arrangement of FIGS. 8 and 9.

The sleeve member 96 is provided with an annular groove 100 formed in the internal cylindrical surface thereof, in which groove are received two pins 102 provided on opposite end portions of a key member 104 shown in detail in FIGS. 10 to 12. The key member 104 is provided with chamfered side surfaces 106, 106' which give the member a prow or boat-like cross-section as shown in FIG. 12. As may be seen more clearly from FIG. 11, the key member 104 passes through a slot 108 formed in the shaft 86.

It will be observed that in FIGS. 8 and 9 the key member 104 is positioned at the left hand end of the slot 108 as viewed in that Figure. It is therefore in engagement with the fixed bearing ring 88 since the surfaces 106 are received in the grooves 94 which are complementarily shaped to accept the chamfered surfaces of the prow configuration of the key member 104.

The operation of the device as described above is similar to that of the previous two examples. Rotation of the shaft 74 and therefore of the cam member 76 causes the shaft 86 to partake of reciprocating axial movement. The key member 104, being held axially captive by the entry of the pins 102 in the groove 100 of the sleeve 96, remains stationary relative to the shaft 86 and within the slot 108 thereof.

Figure 16:
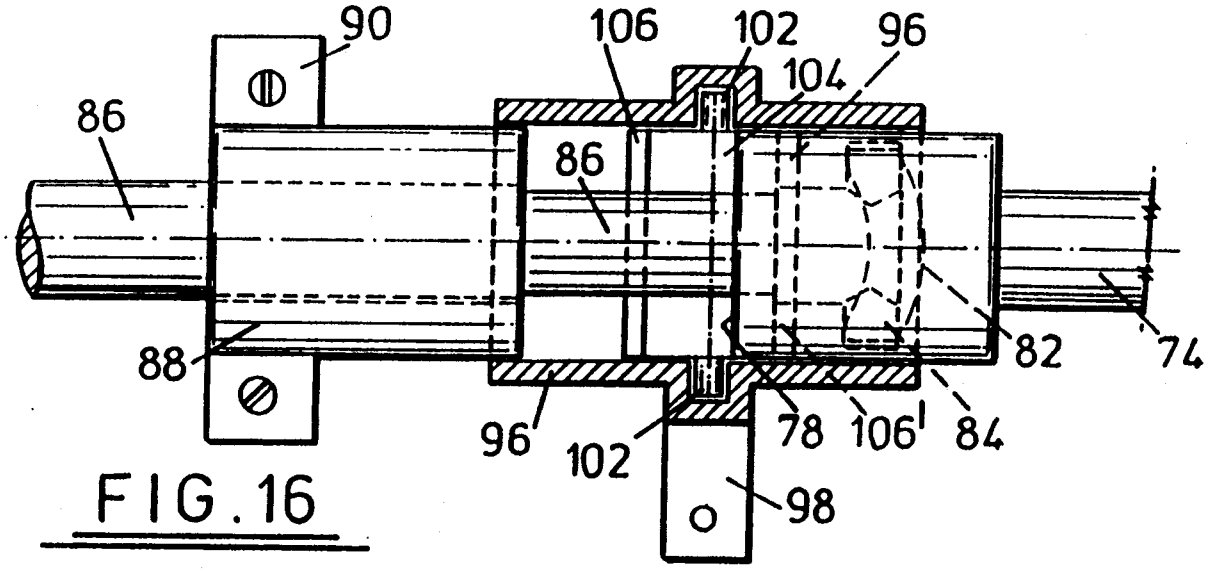
FIGS. 16 and 17 show similar views to those of FIGS. 8 and 9 with the key arrangement set for a second mode of operation.
Figure 17:
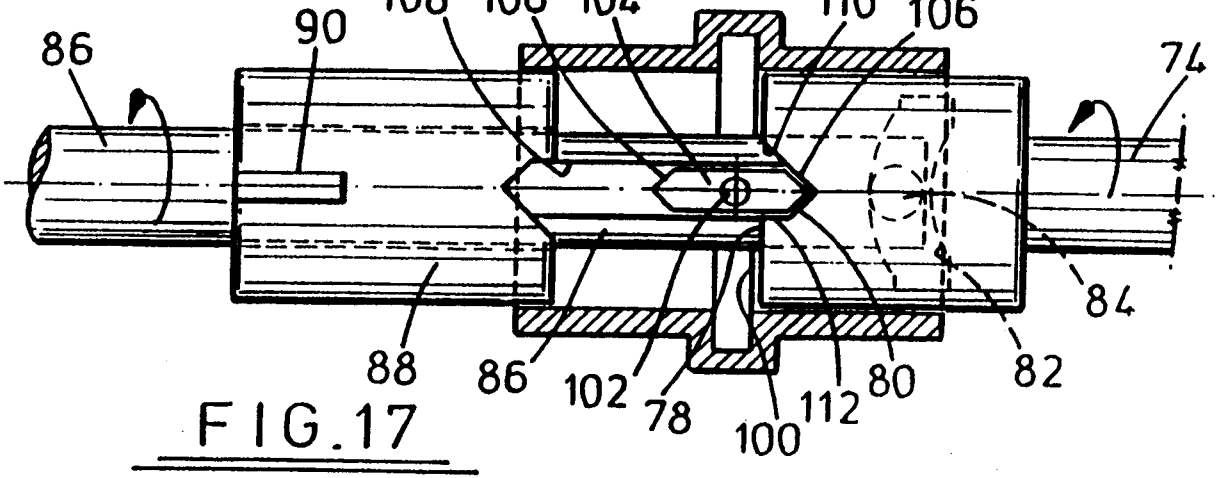

However, in FIGS. 16 and 17 a second operating mode is described. This mode is engaged by movement of the sleeve member 96 to the right as viewed in the drawings, by means of the operating member 98. This action causes the key member 104 to move along the slot towards the right hand end thereof and the surfaces 106' to engage with the groove 94 of the housing of the cam member 76. While a shoulder portion of the groove 94 is cut away at 110 to allow ease of entry of the key member surfaces 106' into the groove 94, an opposite shoulder 112 provides a thrust portion against which the rotational motion of the cam member 76 is transmitted to the key member 104. Because the key member is captive in a rotational sense within the slot 108, the shaft 86 is forced to rotate. Because the cam followers 85 thus remain stationary relative to the cam member 76, there is no reciprocatory movement of the shaft and the power tool device may be used in the manner of a conventional power drill.

Various modifications may be made within the scope of the invention as defined in the following claims.

I claim:

1. A portable power tool means comprising a housing, a drive means and a mounting arrangement for a selected tool bit, said drive means being adapted to drive an output shaft in a reciprocatory axial motion with respect to a longitudinal axis thereof to drive said tool bit, wherein there is provided a rotatable cam member to convert rotary motion from the drive means into said reciprocatory motion, said cam member comprising an integrally assembled cylindrical block containing a generally radially extending bore in the form of a radially corrugated disc and providing a sinusoidal cam track having a plurality of lobes, said bore having at least one passage in communication with the exterior of the block and extending along a longitudinal central axis thereof, said passage being adapted to enclose said output shaft along a portion thereof, said shaft being provided with a plurality of cam follower means arranged equidistantly therearound so as to extend radially from the shaft and to be received within the disc shaped bore of the block, and means being provided to restrain said output shaft against rotation when said output shaft is partaking of said reciprocatory axial motion.

2. A power tool means as claimed in claim 1, wherein said cam follower means comprises pins or rolling members projecting from said shaft into said bore.

3. A power tool means as claimed in claim 1, wherein the output shaft is received in a sliding bearing arrangement in which rotational movement is prevented.

4. A power tool means as claimed in claim 1, wherein the bore of the cam member is a through-bore through which the output shaft passes, said cam member being rotated through an eccentric gearing arrangement from an electric motor.

5. A power tool means as claimed in claim 1, wherein the bore of the cam member is a blind bore into which an end portion of the output shaft carrying said cam follower means is received, means being provided to transfer rotational motion to said cam member from a motor or other source of electricity.

6. A power tool means as claimed in claim 1, wherein there is provided a bearing ring surrounding said output shaft and a sleeve member adapted to be mounted so as to receive at one end thereof at least a portion of said bearing ring and at an opposite end thereof at least a portion of said cam member, a key member being provided so as to project from the output shaft means and capable of engaging with a housing of said bearing ring to prevent rotational movement of the output shaft.

7. A power tool means as claimed in claim 6, wherein the key member is received in a longitudinal slot in the output shaft for sliding movement along said slot or recess between a first position in which the key member engages the housing of the bearing ring and a further position in which the key member engages a housing of the cam member to transfer rotational movement of the output shaft from the cam member to the output shaft.

8. A power tool means as claimed in claim 7, wherein the key member is provided with projection means adapted to engage with an annular groove formed in the interior of the sleeve member, said sleeve member being adapted for sliding movement with respect to the bearing ring and the cam member to move the key member between the first position and the further position.

9. A power tool means as claimed in claim 7, wherein said key member is provided with chamfered leading edge surfaces adapted to engage in notched grooves provided on the housing portion of one of the bearing ring and the cam member.

10. A power tool as claimed in claim 1, wherein the cam member is comprised of two block component portions, each portion defining a sinusoidal surface of said cam track, said surfaces being parallel and arranged to confront each other in a spaced-apart manner.

* * * * *